US010788284B1

(12) United States Patent
Kathe

(10) Patent No.: US 10,788,284 B1
(45) Date of Patent: Sep. 29, 2020

(54) GROUNDED AND VEHICULAR MOUNTED WEAPONS WITH IMPROVED RECOIL STABILITY

(71) Applicant: U.S. Government as Represented by the Secretary of the Army, Picatinny Arsenal, Dover, NJ (US)

(72) Inventor: Eric Kathe, Ballston Lake, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/407,541

(22) Filed: May 9, 2019

(51) Int. Cl.
*F41A 25/02* (2006.01)
*F41A 1/08* (2006.01)
*F41F 1/06* (2006.01)
*F41A 21/28* (2006.01)

(52) U.S. Cl.
CPC ..... *F41A 25/02* (2013.01); *F41A 21/28* (2013.01); *F41F 1/06* (2013.01)

(58) Field of Classification Search
CPC ..... F41A 1/08; F41A 1/10; F41A 1/06; F41A 25/00; F41A 25/02; F41A 25/04
USPC .... 89/1.7, 1.703, 42.01, 42.02, 43.01, 43.02
See application file for complete search history.

(56) References Cited

U.S. PATENT DOCUMENTS 461,347 A * 10/1891 Krone ..... F41A 25/02 89/43.01
557,487 A * 3/1896 Canet ..... F41A 23/46 89/42.02
749,214 A * 1/1904 McClean ..... F41A 3/26 89/185
749,215 A * 1/1904 McClean ..... F41A 25/02 89/43.01
1,108,716 A * 8/1914 Davis ..... F41A 1/08 89/1.702
1,227,161 A * 5/1917 Lehmann et al. ..... F41A 25/18 89/42.01
1,311,780 A 7/1919 Stone
1,322,230 A * 11/1919 Dawson et al. ..... F41A 25/02 89/43.01
1,804,388 A * 5/1931 Conlon ..... F41A 25/02 89/43.01
1,848,304 A * 3/1932 Barnes ..... F41A 25/02 89/43.01
2,088,380 A * 7/1937 Methlin ..... F41A 21/36 89/14.3
2,350,493 A 4/1941 Caulkins
2,337,647 A * 12/1943 Caulkins ..... F41C 27/06 89/1.3

(Continued)

FOREIGN PATENT DOCUMENTS

GB 121040 8/1919

*Primary Examiner* — Derrick R Morgan
(74) *Attorney, Agent, or Firm* — John P. DiScala

(57) ABSTRACT

A counter momentum generator is employed on a weapon system to manage horizontal recoil momentum of the weapon system. The counter momentum generator generates a counter momentum which that is not parallel to the recoil momentum. A horizontal component of the counter momentum negates a portion of the horizontal recoil momentum. A vertical component of the counter momentum combines with the vertical recoil momentum to aid in compression between the base of the weapon system and the ground.

20 Claims, 9 Drawing Sheets

(56) References Cited

U.S. PATENT DOCUMENTS 2,413,703 A * 1/1947 Fischer ..... F41A 25/18 89/1.35
2,417,983 A * 3/1947 Holman ..... F41A 21/14 89/1.3
2,466,714 A * 4/1949 Kroeger ..... F41A 1/08 89/1.703
2,489,747 A * 11/1949 Burney ..... F41A 1/08 89/1.703
2,489,748 A * 11/1949 Burney ..... F41A 1/08 89/1.703
2,489,954 A * 11/1949 Burney ..... F41A 1/08 89/1.704
2,515,180 A * 7/1950 Barker ..... F41A 1/08 89/1.7
2,567,826 A * 9/1951 Prache ..... F41A 21/36 89/14.3
2,598,256 A * 5/1952 Hickman ..... F41A 1/08 89/1.703
2,741,160 A 4/1956 Musser
2,789,471 A * 4/1957 Bluford ..... F41A 1/08 89/1.704
2,834,255 A * 5/1958 Walton ..... F41A 1/08 89/1.706
2,889,747 A * 6/1959 Kamp ..... F41A 3/76 89/1.704
2,920,533 A * 1/1960 Walton ..... F41A 1/08 89/1.706
2,924,149 A * 2/1960 Walton ..... F41A 1/08 89/1.703
2,965,000 A * 12/1960 Skinner ..... F41A 1/08 89/1.7
2,972,946 A 2/1961 Poulter
2,984,156 A * 5/1961 Edin ..... C01B 7/01 89/1.705
2,986,072 A * 5/1961 Hudson ..... F42B 5/16 89/7
2,986,973 A * 6/1961 Waxman ..... F41A 1/06 89/1.703
3,005,386 A * 10/1961 Walton ..... F41A 1/08 89/1.706
3,008,378 A * 11/1961 Walton ..... F41A 1/08 89/1.703
3,011,409 A 12/1961 Musser
3,029,635 A * 4/1962 Fetz ..... G01M 9/02 73/147
3,035,494 A * 5/1962 Walton ..... F41A 1/08 89/1.703
3,101,028 A * 8/1963 Berge ..... F41A 23/34 89/14.3
3,128,670 A * 4/1964 Blacker ..... F41A 1/10 89/1.702
3,194,118 A * 7/1965 Walton ..... F41A 1/08 89/1.704
3,338,133 A * 8/1967 Grandy ..... F41A 1/08 89/1.703
3,490,330 A * 1/1970 Willi ..... F41A 1/08 89/1.7
3,505,958 A * 4/1970 Vilbajo ..... F41A 1/08 102/437
3,595,127 A 7/1971 Stangl
3,628,415 A * 12/1971 McElroy ..... F41A 1/06 89/14.05
3,946,637 A * 3/1976 Campagnuolo ..... F41A 1/06 89/1.3
4,012,986 A 3/1977 Germershausen
4,043,248 A * 8/1977 Bulman ..... F41A 1/04 89/1.703
4,106,389 A * 8/1978 Walley ..... B64D 7/06 244/118.1
4,132,149 A * 1/1979 Ashley ..... F42B 5/16 89/1.704
4,327,624 A * 5/1982 Piesik ..... F41F 3/0455 89/1.703
4,404,887 A * 9/1983 Piesik ..... F41F 3/0455 89/1.703
4,554,860 A * 11/1985 Johansson ..... F41A 1/08 89/1.7
5,345,853 A 9/1994 Crepin
6,460,446 B1 10/2002 Kathe
7,202,809 B1 4/2007 Schade
7,997,220 B1 * 8/2011 Beal ..... B63B 3/00 114/65 R
8,707,846 B2 4/2014 Kohnen
9,500,420 B2 * 11/2016 Widder ..... F42B 5/184
10,520,272 B1 * 12/2019 Carson ..... F41A 21/36
2005/0108917 A1 * 5/2005 Kunstmann ..... F41F 3/0413 42/135
2005/0235816 A1 * 10/2005 Franzen ..... F41A 1/10 89/1.701
2006/0011056 A1 * 1/2006 Edwards ..... F41A 25/02 89/14.3
2008/0289236 A1 * 11/2008 Fischer ..... F41A 21/36 42/1.06
2009/0031912 A1 * 2/2009 Gilbert ..... F41A 1/08 102/437
2010/0275763 A1 * 11/2010 Malmlof ..... F41A 1/08 89/1.703
2014/0076134 A1 * 3/2014 Schroeder ..... F41A 1/08 89/1.816
2014/0137730 A1 5/2014 Beckmann
2017/0261282 A1 * 9/2017 Griffitts ..... F41A 21/36

* cited by examiner

GROUNDED AND VEHICULAR MOUNTED WEAPONS WITH IMPROVED RECOIL STABILITY

STATEMENT OF GOVERNMENT INTEREST

The inventions described herein may be manufactured, used and licensed by or for the United States Government.

BACKGROUND OF THE INVENTION

The invention relates in general to weapon systems and in particular to grounded and vehicular mounted cannons.

Recoil forces are generated in response to a projectile exiting a gun tube. These forces can reduce the stability of low elevation firing guns and in the case of certain weapon systems, such as baseplate mortars, limit the elevation angle from which they can be fired.

This problem has existed since the first grounded baseplate mortars were fielded. Baseplates often couple the recoil momentum of firing through a ball and socket joint that connects the breech of the cannon to the baseplate. The ball and socket joint allows the cannon to be oriented in both azimuth and elevation without requiring the movement of the baseplate. Often round, the baseplate couples the recoil forces to the earthen soil upon which it rests.

The horizontal component of recoil relative to total recoil increases as the elevation is decreased and may lead to undesirable rearward movement of the baseplate and a related loss of firing stability. Horizontal stability of soil subjected to a horizontal force may often be lost if insufficient vertical compressive force is not concurrently applied. Accordingly, mortars are generally limited to high-angle fire of at least 45°.

Limitations in minimum firing elevation prevents the use of these weapons in direct fire. This is unfortunate, as direct fire can engage close targets more accurately and with reduced time of flight which can be very important for self-defense. Direct fire also provides means to engage the vertical sides of targets such as buildings. Finally, direct fires reduces the maximum ballistic trajectory altitude of the round thereby reducing concerns of shared airspace with close support aircraft.

The problem of horizontal stability has also existed for grounded spade and outrigger emplaced weapons. Historic wheeled artillery cannon field carriages typically allowed the entire lower carriage to roll rearward in response to horizontal recoil. These carriages employed long beams or trails projecting rearward that were fitted with iron shoes that rested upon the ground prior to firing. While the carriage rolled rearward, the shoes would slide and float along the top of the earth developing some level of friction to slow the recoil but also providing a righting torque to prevent the carriage from overturning. The vertical component of recoil had to be endured by the carriage and was coupled to the earth largely through the wheels.

The 75 mm field gun M 1897, the French 75, was an early example of a gun fitted with a recoil system. With the advent of the French 75, spades were fitted in lieu of shoes to bind the trails to the earth and inhibit motion of the lower carriage. The recoil system attenuated the recoil forces which could then be managed by a lighter weight lower carriage. Nevertheless, the need for strong trails to endure compressive loading without buckling and large spades to distribute horizontal forces over larger areas of earth result in undesirable weight. This additional weight may be alleviated if horizontal recoil is reduced or eliminated.

It is well known that towed howitzers fired in loose soils are readily capable of not only shifting but their spades may raise and project soil rearwards in response to firing. These negative consequences may be lessened as horizontal recoil is reduced or eliminated.

Vehicular mounted weapons have been subject to recoil limitations when firing off their suspension. Most vehicle mounted cannons apply the horizontal component of recoil above the center of mass of the vehicle hull which is itself suspended above the terrain by its suspension (possibly augmented by spades or other stabilizing outriggers). The torque resulting from this momentum arm is coupled with the horizontal ground resistance in the opposite direction and beneath the center of mass. Thus, the two torques additively combine in the same rotational direction. The combined torque tends to rock the vehicle compromising stability and may tax the bearing strength of the soil beneath. By altering the resultant torque, the rocking may be reduced.

A need exists for an approach to recoil stability to solve several related issues which include reducing the minimum elevation for baseplate mortars thereby enabling horizontal or depressed fires, reducing the size, weight and emplacement burden of recoil spades that are commonly employed on towed artillery cannons to achieve firing stability and to reduce excessive vehicular horizontal recoil response.

SUMMARY OF INVENTION

One aspect of the invention is a system comprising a cannon for launching a projectile and a counter momentum generator coupled to the cannon for producing a counter momentum for countering a recoil momentum of the weapon system. The counter momentum is substantially concurrent with the recoil momentum and has a vertical component and a horizontal component. The vertical component typically combines with a vertical component of the recoil momentum. The horizontal component negates a portion of the horizontal component of the recoil momentum.

Another aspect of the invention is a weapon system capable of firing a projectile at low elevation angles, the mortar weapon system comprising a cannon, a barbette pedestal, a baseplate and a counter momentum generator. The cannon is mounted on the barbette pedestal and further comprises integral trunnion pins. The barbette pedestal mounts the cannon to the baseplate and serves as a pivot yoke for the integral trunnion pins to allow elevation of cannon. The baseplate has a bottom surface in contact with the external surface and a top surface on which the barbette pedestal is pivotably mounted. The counter momentum generator coupled to the cannon produces a counter momentum for countering a recoil momentum of the weapon system and includes a venturi nozzle and an outlet nozzle. The counter momentum is substantially concurrent with the recoil momentum and has a vertical component and a horizontal component. The vertical component combines with a vertical component of the recoil momentum to increase the compressive force between the baseplate and the external surface. The horizontal component negates a portion of the horizontal component of the recoil momentum. The counter recoil generator further includes a venturi nozzle extending from an interior of the cannon through the integral trunnion pins. The outlet nozzle has an input in communication with the output of the venturi nozzle and an output to the external environment.

It is an object of this invention to provide a solution to meet the minimum elevation stability constraints of baseplate mounted cannons. This is achieved by firing a projectile at a lower elevation while also discharging counter momentum opposite in azimuth and at its own angle of elevation. The direction of the combined forces may then be designed to satisfy the minimum elevation requirement of the baseplate.

As a corollary to this first objective, it is an objective of this invention to provide a means to reduce the reliance upon vertically projected elements to stabilize baseplates to meet a minimum firing stability constraint. E.g., we could use this invention to maintain a firing angle of $\alpha$=45° but achieve a net angle of 0=69.30 to cut the horizontal momentum in half. This may cut in half the size of the required spades integrated into the baseplate making it lighter and easier to emplace.

It is an object of this invention to use this same inventive concept to reduce or eliminate the size and bulk of spades, trails, and turntables required of towed artillery carriages to endure recoil.

It is a further object of this invention to use this same inventive concept to reduce the rocking response of vehicles when firing mounted cannons from ground vehicles or watercraft.

It is an object of this invention to provide the design option to project the counter momentum material upwards to reduce the rearward extent of any hazard area presented behind the weapon.

It is an object of this invention to have the option to extend the length of the counter momentum generator to further remove the potential noise, blast, and other hazards away from weapon to better allow weapon servicing and manned access. This may be done using nozzle blast tubes or any means to extend the discharge location using a suitably compact passage.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A counter momentum generator is employed on a weapon system to allow for low elevation fires by baseplate mounted cannons, to reduce the size and weight of spade and outrigger supported cannons or to reduce the rocking response of vehicular mounted cannons. The counter momentum generators develops a counter momentum, also referred to as a counter momentum, that is structurally coupled to the weapon but which is not parallel to the recoil momentum. A horizontal component of the counter momentum negates a portion of the horizontal recoil momentum. A vertical component of the counter momentum combines with the vertical recoil momentum to aid in compression between the base of the weapon system and the ground. In combination, they produce a more desirable net momentum vector tailored to the particular application. Unlike recoilless guns and most muzzle brakes, the generated counter momentum is not parallel and coaxial with the launch recoil momentum. As the system does not seek to eliminate recoil, the magnitude of the cancellation momentum need not be fixed to eliminate recoil.

For baseplate mounted cannon, the net momentum may be oriented to satisfy the minimum launch elevation of a baseplate while enabling the launch momentum to be oriented below this minimum elevation. For spade and outrigger cannons, the horizontal component of the net momentum may be reduced and the resultant net momentum may be oriented to reduce or negate a net torque on the cannon. With less horizontal momentum, the size and weight of lower carriage elements intended to endure horizontal momentum, such as trails and spades may be reduced. For vehicular mounted cannon, the rocking response of the vehicle may be reduced thereby allowing for higher launch momentum to be tolerated without excessively raising road wheels in response.

The approach of utilizing a counter momentum generator is described in the context of baseplate mounted cannons, such as mortar weapon systems, outrigger or spade stabilized cannons, such as towed artillery systems and vehicular mounted cannons such as both mortar and artillery weapon systems. However, the approach is not limited to these weapon systems or to weapon systems alone. The teachings of this specification may be applied to any system which generates a recoil momentum. For example, a counter momentum generator may be employed by ship-borne cannons or railguns. Further, a counter momentum generator may be employed on a non-weapon system such as slingatrons, catapults, railguns and a space gun, or Verne gun, for delivering payloads into orbit.

Figure 1:
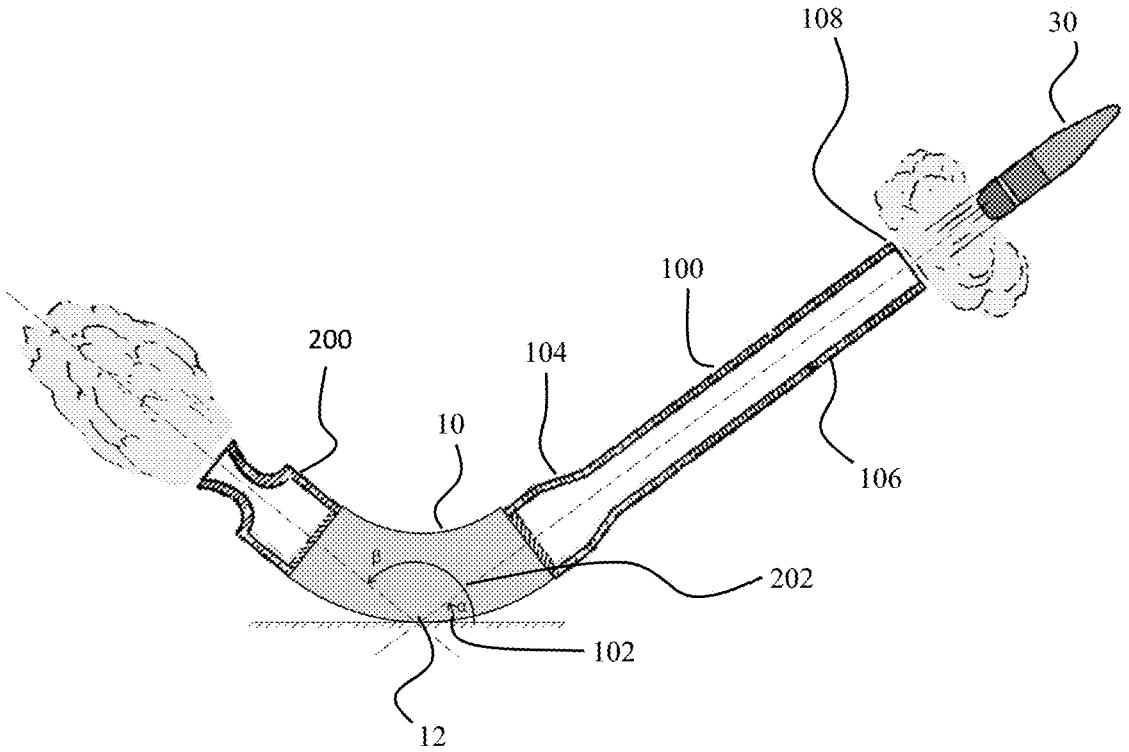
FIG. 1 is a cross sectional side view of a cannon system with a counter momentum generator, according to one illustrative embodiment.

FIG. 1 is an illustration of a cross sectional side view of a system with a counter momentum generator, according to one illustrative embodiment. The illustration is a simplified depiction of the system 10 to illustrate the operating principles. In practice, the system would comprise components including at least a mounting structure, such as a baseplate and support structure, such as a bipod. In other embodiments, the system may comprise a carriage or a vehicle including other stabilizing elements including spades, outriggers, firing jacks and floats and turntables. The depiction shows the cannon system 10 shortly after projectile 30 exit with the notional escape of propellant from both the muzzle of the cannon and the nozzle of the counter momentum generator.

The cannon system 10 comprises a cannon 100 and a counter momentum generator 200. The cannon 100 is oriented at an elevation angle alpha 102 with respect to the horizontal and further comprises a breech 104, a bore 106 and a muzzle 108. The breech 104 serves as a pressure vessel thereby containing the propellant gases which propel the projectile 30 through the bore 106 and out of the muzzle 108.

The counter momentum generator is oriented at a discharge angle beta 202 with respect to the horizontal. As will described in further detail below, the counter momentum generator 200 generates the counter momentum 210 by expelling mass. The mass may include a projectile or propellant gases.

For simplicity, the center of gravity may be considered to vertically pass the weight of the weapon through point 12 and is not shown. As the weight is very small relative to ballistic forces, it may be neglected. In addition, the bend in the barrel is depicted as a simple extended rigid structure forming a partition. In practice, the partition would more likely contribute as a pressure vessel containing propellant. The bottom of the curved bend is coincident with a horizontal rigid ground boundary condition. The recoil and counter momentum vectors are oriented through point 12 where the bend meets the boundary condition such that no torque is applied to the weapon.

The cannon system launches a projectile from the cannon. The exit of the projectile causes an opposing recoil momentum 110 in the direction alpha 102. The counter momentum generator generates a counter momentum 210 in response which serves to reinforce the vertical recoil momentum and alleviate some of the horizontal recoil momentum. The counter momentum is applied at the larger angle β 202.

Figure 2:
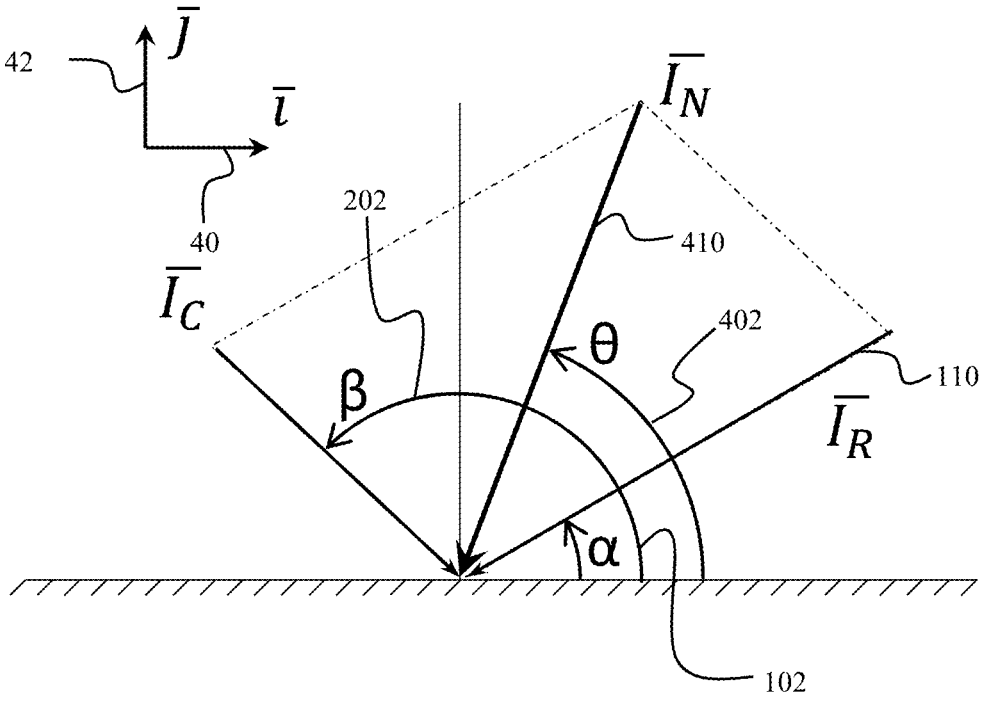
FIG. 2 is a schematic showing momentum vectors of the cannon system of FIG. 1, according to one illustrative embodiment.

FIG. 2 is a schematic showing momentum vectors of the cannon system of FIG. 1, in accordance with an illustrative embodiment. A simplified mathematic treatment of the advantages may be realized by considering the vector addition of the launch recoil momentum 110 and counter momentum 210 about a point where the two vectors cross. This may be envisioned as occurring at the pivot point of a rigid mortar baseplate although the findings are more general.

As shown in FIG. 2, i and j are the horizontal unit vector 40 and vertical unit vector 42 reflecting positive direction up and to the right with an elevation above the horizontal of a for the fired projectile. The launch recoil momentum 110 is oriented down and to the left. It is of equal magnitude but opposite direction of the launch momentum of the fired projectile and muzzle gases that would be upward and to the right. The firing elevation 102 is constrained such that $-90° \leq \alpha \leq 90°$ with excessive depression being considered uncommon.

The counter momentum 210 is depicted down and to the right. This too is of equal magnitude but opposite direction to the discharge momentum of the material (propellant gas and possible incompressible Davis mass) ejected upwards and to the left at an angle of β 202. The net momentum 410 is the vector addition of these two mimicking the recoil of an effective firing elevation above the horizontal of θ 402.

While not absolutely constrained, a likely desired range for the net elevation 402 is $\alpha < \theta \leq 90°$ such that the net momentum 410 imparted is downward and the left (or lacking a horizontal contribution with θ=90°). The momentum imparted by the ground reaction would be equal and opposite to this pushing upwards and to the right. As all forces pass through the same point in space at a rigid boundary condition, no motion is imparted to the weapon. A broken line reflects the parallelogram law interpretation of vector addition. As the intent is for the counter momentum 210 to reduce net horizontal momentum the counter discharge angle 202 is constrained to $90° \leq \beta \leq 270°$. As the vertical component of the counter momentum 210 is generally desired to augment elevated firing momentum, P in excess of 180° is considered uncommon.

The recoil momentum 110 may be expressed by:

$$\bar{I}_R = \bar{I}_R((-\cos\alpha)\bar{i} + (-\sin\alpha)) = -\bar{I}_L$$

The counter momentum 202 may be expressed by:

$$\bar{I}_C = \bar{I}_C((-\cos\beta)\bar{i} + (-\sin\beta))\bar{j}$$

Accordingly, the net momentum 410 may be calculated as:

$$\bar{I}_N = (I_R(-\cos\alpha) I_C(-\cos\beta))\bar{i} + (I_R(-\sin\alpha) + I_C(-\sin\beta))\bar{j}$$

The angle 402, theta, at which the net momentum 410 acts can be calculated by the following equation:

$$\tan\theta = \frac{I_R \sin\alpha + I_C \sin\beta}{I_R \cos\alpha + I_C \cos\beta}$$

It is illustrative to consider the case where θ=90°. This requires the elimination of the horizontal component of the net momentum 410. To state another way, $I_R \cos\alpha = -I_C \cos\beta$.

The minimum counter momentum 410 required to achieve this occurs at β=180° with a magnitude exactly equal to the horizontal component of recoil. Note that a recoilless gun achieves this feat with IR=IC and β=α+180°. As the discharge angle 202 is reduced from this case more counter momentum 210 is required. At β=135° the magnitude of the counter momentum 210 required increases by the square root of two (141%).

Figure 3:
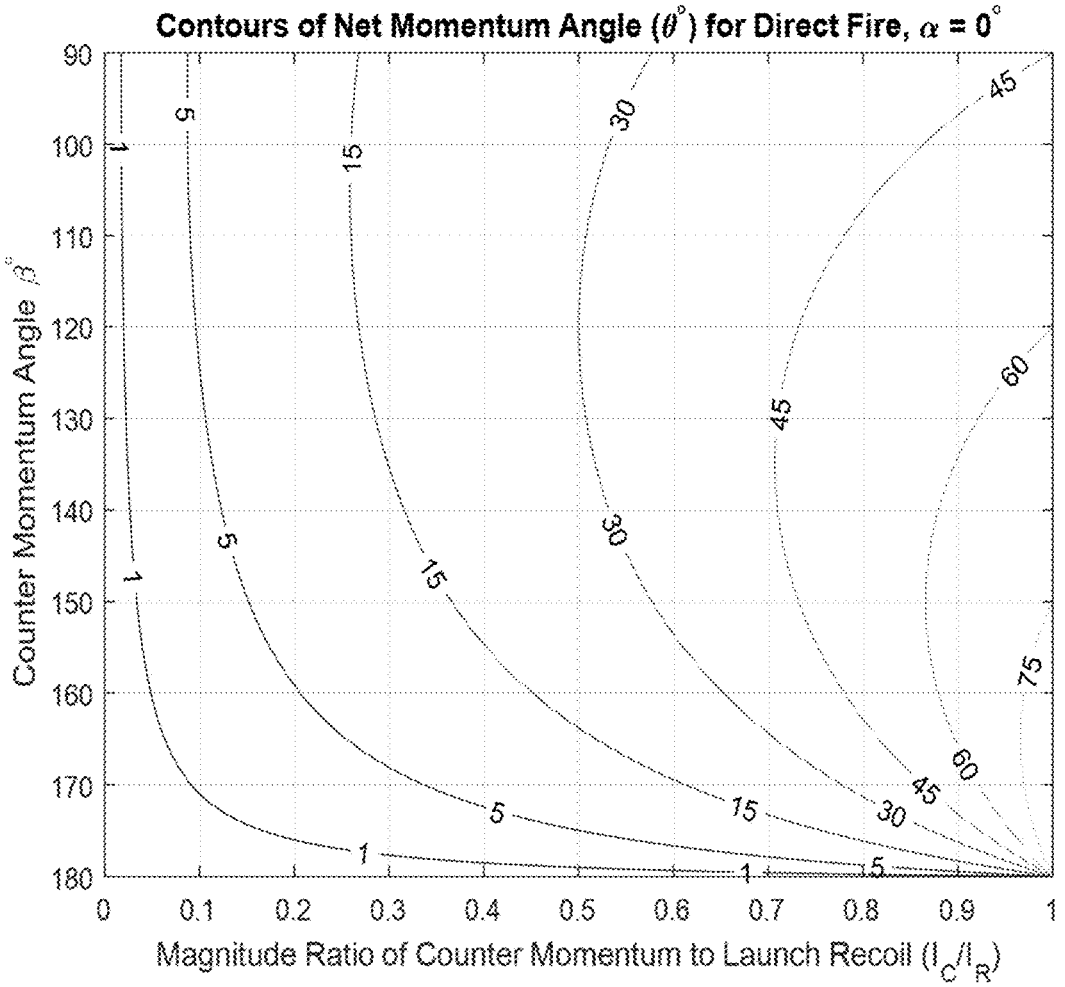
FIG. 3 is a contour plot of net momentum angles for direct fire with respect to both the ratio of counter to recoil momentum and counter momentum discharge angle, according to one illustrative embodiment.

It is also illustrative to consider horizontal fire with α=0° as a function of both the ratio of counter momentum 210 to recoil momentum 110 (IC/IR) and counter momentum discharge angle β 202. FIG. 3 is a contour plot of net momentum 410 angles for direct fire with respect to both the ratio of counter momentum 210 to recoil momentum 110 and counter momentum discharge angle 202, according to one illustrative embodiment.

Note that when the counter momentum 210 is equal to the launch recoil at β=180° we have a direct fire recoilless gun and a singularity as there is no angle associated with a zero magnitude net momentum 410. If directed at β=90° the two equal magnitude and orthogonal vectors achieve a net angle of θ=45°. Interestingly, achieving a net θ=45° angle 402 can be met with a nearly 30% reduction in counter momentum 210 relative to the recoilless gun at β=135°. This could reduce the size and bulk of the munitions as the consumables required to achieve this are reduced. Small net firing angles 102 of 1°, 5°, and 15° are included to show the behavior at the extremes of counter momentum 210 being nearly horizontal (β near to 180°) and (IC/IR) vanishingly small. It is interesting to note that when the plotted contour lines provide two solutions for 180°≥β≥90° for a given ratio of (IC/IR), the more highly elevated orientation (β nearer to 90°) projects the hazard imposed by the counter momentum 210 higher up and away from the ground. But, the net vertical momentum is increased for this solution.

Figure 4:
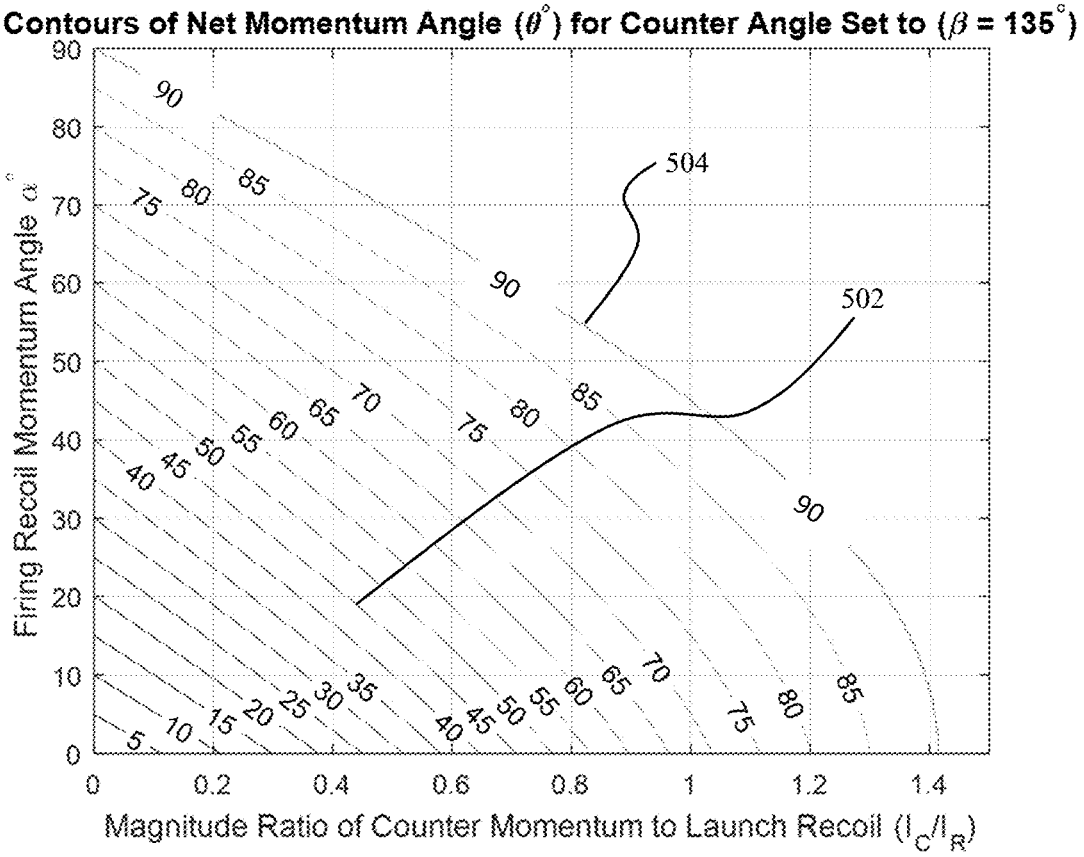
FIG. 4 is a contour plot of net momentum angles for fire with a fixed counter momentum angle of 135 degrees with respect to both the ratio of counter to recoil momentum and launch momentum discharge angle, according to one illustrative embodiment.

It is also illustrative to consider the net momentum angle 402 with a fixed cancellation momentum angle 202 of β=135° as a function of both the ratio of counter momentum 210 to recoil momentum 110 (IC/IR) and launch momentum discharge angle α. FIG. 4 is a contour plot of net momentum angles 402 for fire with a fixed counter momentum angle of 135 degrees with respect to both the ratio of counter momentum 210 to recoil momentum 110 and launch momentum angle 102, according to one illustrative embodiment.

If the minimum net elevation tolerable for a baseplate is 45° then no counter momentum 210 is required when the firing momentum angle 102 α≥45°. The magnitude of the required counter momentum 210 discharged at β=135° to maintain the net angle 402 θ=45° for 0°≤α<45° may be read off the corresponding contour line 502. Although slightly curved, this contour follows a nearly straight line from α=45° with zero counter momentum 210 to α=0° at approximately (IC/IR)=70% (or 30% less than 100% as observed above). The upper contour 504 represents the elimination of the horizontal component of net recoil with θ=90°.

Figure 5:
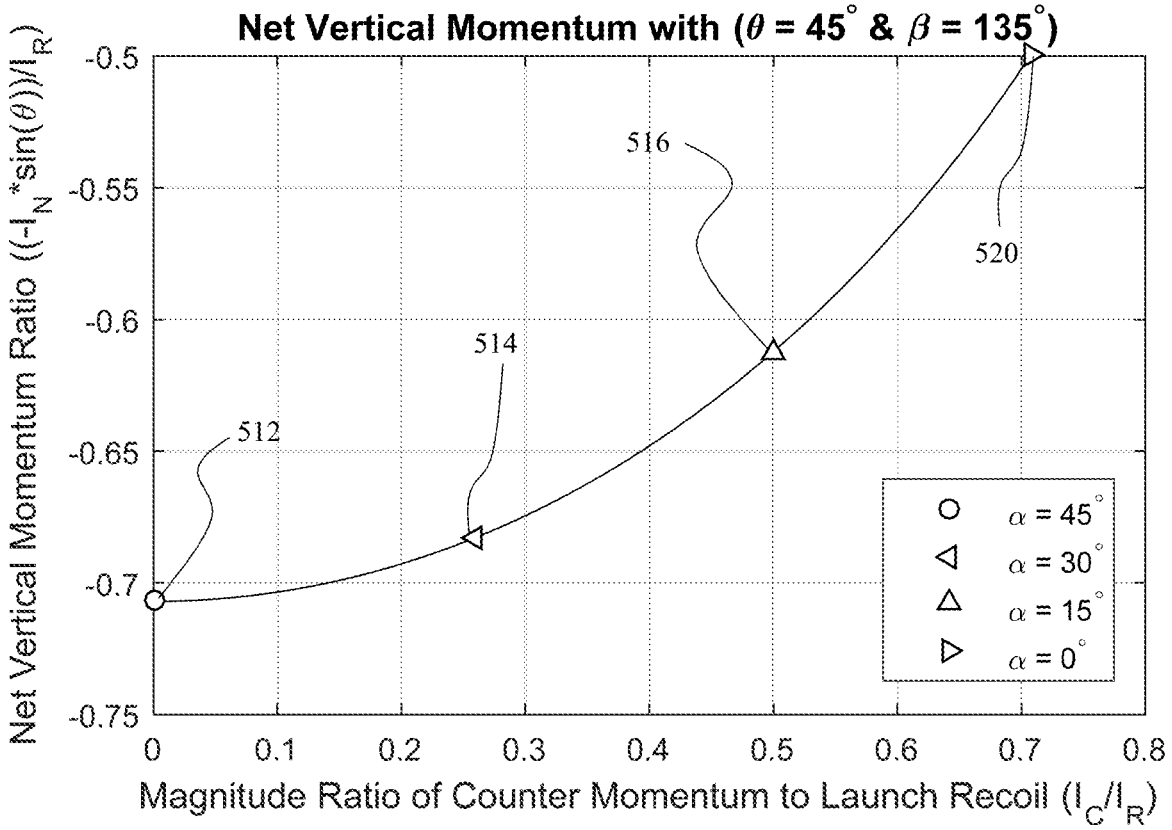
FIG. 5 is a plot of the net vertical momentum for $\beta$=135° and (IC/IR) solved to follow the contour with the net angle $\theta$=450, according to one illustrative embodiment.

FIG. 5 is a plot of the net vertical momentum for β=135° and (IC/IR) solved to follow the contour with the net angle 402 θ=45°, according to one illustrative embodiment. Firing elevations of α=0°, 15°, 30°, and 45° are plotted as points 512, 514, 516 and 518, respectively, as well to clarify the relation between a and (IC/IR) shown above.

The net vertical momentum is negative to convey it is pushing downward into the ground (or water for watercraft). It is of interest to note that the net vertical momentum shown for α<450 continuously decreases as a decreases despite the increasing counter momentum 210 IC to maintain θ=45°. The worst case vertical momentum would remain high elevation firing with α closer to 90° and no counter momentum 210. The extreme would occur at −IR at IC=0 and α=90°. Historically firing at α=900 has not been desired due in part to the self-evident hazard such firing would present to the crew. However the development of reliable course altering projectiles may reduce this concern.

Advantageously, a larger baseplate is not required to endure recoil from both the launch and counter momentum generator. In addition to the reduction of the vertical momentum component, the partial cancellation of horizontal momentum for 0°≤α<45° conveys the illustrative finding. The net momentum 410 is rendered smaller for both vertical and horizontal components relative to firing at α=45°.

The counter momentum generator may be embodied on a mortar weapon system, and in particular, a baseplate mortar weapon system. The counter momentum generator increases the minimum elevation stability constraints of baseplate mounted cannons by firing a projectile at a lower elevation while also discharging counter momentum 210 opposite in azimuth and at its own angle 202 of elevation. Baseplates often comprise a ball and socket joint that connects the breech of the cannon to the baseplate. The ball and socket joint allows the cannon to be oriented in both azimuth and elevation without requiring the movement of the baseplate. Often round, the baseplate couples the recoil forces to the earthen soil upon which it rests. The direction of the combined forces may then be designed to satisfy the minimum elevation requirement of the baseplate.

In addition, the counter momentum generator provides a means to reduce the reliance upon vertically projected elements to stabilize baseplates to meet a minimum firing stability constraint. For example, the counter momentum generator may allow a mortar weapon system to maintain a firing angle of α=45° but achieve a net angle of θ=69.3° to cut the horizontal momentum in half. This may cut in half the size of the required spades integrated into the baseplate making it lighter and easier to emplace.

The counter momentum generator may be embodied on a towed or self-propelled artillery weapon system. Contemporary field artillery is supported by carriage which may be towed or self-propelled. Contemporary field artillery cannon may further employ firing jacks and floats or turntables to endure the majority of vertical recoil without reliance upon the transportation wheels of the lower carriage to provide stability. Jacks raise the lower carriage and employ a float between them and earth to distribute the weight and much of the vertical recoil momentum of the weapon over a large enough area of soil that it may endure the forces. Turntables provide a similar function but are centered beneath the azimuthal pivot of the weapon to allow 360 degrees of traverse. Floats, turntables and mortar baseplates are similar in function in that they distribute recoil forces over a significant area of ground that is in contact with them. Baseplates are typically unique in that the elevation pivot point is integrated at or modestly below the ground level. Whereas, lower carriages supported by floats and turntables support upper carriages that pivot in elevation above the ground level.

The counter momentum generator may be employed on a towed artillery system to reduce or eliminate the size and bulk of spades, trails, and turntables required of towed artillery carriages to endure recoil. Additionally, the counter momentum generator may be employed to reduce the rocking response of vehicles when firing mounted cannons from ground vehicles or watercraft.

There are several approaches to implementing a momentum generator on cannon weapon systems, such as mortar weapon systems or artillery weapon systems. The momentum generator may be separate or isolated from the cannon pressure source. In these approaches the counter momentum generator may include separate rocket engines or guns intended to fire while the cannon is undergoing recoil motion to improve recoil stability. This approach is particularly suited for applications involving single use weapon systems.

In certain embodiments, the weapon system comprises a small conduit for communication of the cannon and counter momentum pressure sufficient to communicate heat and pressure for ignition from the one that fires first to the other. The conduit is sized and dimensioned sufficiently small such that the mass passing through it would be insignificant with respect to shifting momentum generation from the first one that fires to the second one that fires or vice versa.

In embodiments, the counter momentum generator may fire for a duration longer than that of the cannon. For cannon mountings within a recoiling gun mount, this may allow the duration and intensity of the counter momentum 210 to better align with those of recoil arresting force reactions applied through the gun mount to the vehicle, weapon platform, or ground.

In embodiments, the counter momentum generator may be a pre-fired momentum generator in which the counter momentum generator may commence fire before the cannon. Such a counter momentum generator may assist in achieving favorable fire out of battery performance.

Alternatively, the counter momentum generator may be a post-fired momentum generators which fires after the cannon. A post-fired momentum generator may increase accuracy by preventing disturbance loading while the cannon functions.

Integrated momentum generators couple the cannon propellant with that of the counter momentum generator with a significant shifting of momentum generating capability between the two. Those familiar with the art may appreciate that distance between the port(s) from the cannon to the ultimate counter momentum discharge location will result in internal forces and delay times as the propellant transits the passage between the two.

In baseplate mortar applications, caution should be exercised when using delayed counter momentum approaches such as ducted muzzle brakes. This is because peak recoil forces may occur earlier in the ballistic cycle when fired from stiff soil rendering the counter momentum 210 too late to prevent excessive motion.

The counter momentum discharge can be located at any design location along the length of the cannon or possibly extended beyond the muzzle or behind the breech some distance. In embodiments, the counter momentum generator shares a common pressure source with the cannon gun chamber (and thus before projectile motion). For example, a counter momentum generator may employ a port into a breech block or closure (as in the frame of a revolving cannon guns) of the cannon. This provides a simple method to alter a gun to employ a counter momentum generator or switch to a mode without such a generator by using a breech closure with a port, or using one that does not have a port. Alternatively, a counter momentum generator sharing a common pressure source with the gun chamber may employ a port or ports through the gun chamber wall.

In embodiments, the counter momentum generator may share a common pressure source with some intermediate location along the cannon bore before the muzzle that is not active until the projectile passes over the location. In other embodiments, the counter momentum generator shares a common pressure source with the muzzle. In other embodiments, the counter momentum generator may employ a delayed venting elsewhere along the bore as has been employed by sonic rarefaction wave recoilless gun systems which is further described in co-owned U.S. Pat. No. 6,460,446, entitled "Sonic Rarefaction Wave Recoilless Gun System" to the present inventor, the entire contents of which are herein incorporated by reference.

The integral counter momentum generator may be augmented in some embodiments. For example, the counter momentum generator may include additional propellant (initially not combusted) that is separated from the cannon volume. In this embodiment, the cannon volume and counter momentum generator are separated by a flow area restriction that chokes the flow at some point during operation. As another example, the counter momentum generator may employ a counter projectile for additional momentum generation. However, counter momentum generator, as used throughout this specification, does not comprise an additional cannon of the same caliber as the first cannon and concurrently firing a counter projectile of the same size as the original projectile from a common propellant.

Another design variable which may be selected according to desired performance and application is the location of the chocked flow point between the cannon pressure and counter momentum generator.

Un-choked counter momentum generators lack a flow restriction between the cannon and counter momentum generator. These are analogous to improved versions of recoilless or Davis guns that introduce a bend along the common chamber to produce off-axis momentum. Yet they do not introduce a flow restriction to choke flow between the two functions.

Choked generators introduce a flow restriction between the cannon and counter moment generator that serves to choke the flow during operation. A counter momentum generator having a cannon egress choke chokes the flow as it exits the cannon. By designing the downstream flow passage to be able to swallow any normal shocks that might otherwise form, such a design achieves relatively low pressure downstream of the egress choke. Turning the propellant flow to vector the thrust will need to be done carefully thereby generating oblique shocks with an ample increase in cross sectional area and bulk in order to take advantage of the lower downstream pressure.

A counter momentum generator comprising a downstream choke intentionally chokes propellant gas flow downstream of the cannon egress port. This results in high pressure subsonic flow between the high pressure cannon and the choke. Such a counter momentum generator is simpler in design as the subsonic flow is readily turned and vectored without concern of shock formation. However, the higher pressure places additional containment burden on the structure.

For counter momentum generators employing a counter projectile, this form of generator would initially arrest the flow of the pressurized gas within the counter momentum generator and may therefore be anticipated to achieve a downstream obstruction of the flow.

In embodiments, the counter momentum generator may comprise a reservoir volume. By coupling a downstream choke with a significant reservoir volume between itself and the cannon egress port, the momentum generator function will increase in duration with potential decreases in peak thrust force (and noise or blast hazards). For cannon mountings within a recoiling gun mount, this may allow the duration and intensity of the counter momentum to better align with those of recoil arresting force reactions applied through the gun mount to the vehicle, weapon platform, or ground. In embodiments, the reservoir may aid in flushing or evacuating the gun like a bore evacuator.

In embodiments of the invention, the counter momentum generator further comprises one or more ports to control the operation of the counter momentum generator.

The ports may be binary on-off ports to defeat counter momentum generators when off and allow counter momentum generation when on.

In other embodiments, the ports are throttled ports that regulate flow restriction area to control mass flow rates. For example, the ports may be analogous in operation to a rocket plug or pintle thrust controls. Controlling the mass flow alters the amount of counter momentum generated. It also alters the pressure within the launch bore and thereby alters the interior ballistics and launch momentum and velocity.

The ports may comprise open loop throttles or closed loop throttles. Open loop throttles are set prior to firing and lack feedback during the interior ballistics. Closed loop throttles change throttling performance during firing according to feedback.

The ports may comprise ignition throttles that inhibit propellant flow from the cannon during ignition to improve cannon performance. This may be achieved for example with a lightweight spring loaded flap valve. Another example would be to incorporate a rupture element within a disposable cartridge case.

It is an advantage of weapon systems comprising a counter momentum generator in that they provide the design option to project the counter momentum material upwards to reduce the rearward extent of any hazard area presented behind the weapon. Embodiments of the current invention may employ blast tubes to extend the discharge location of the counter momentum generator further from the weapon to reduce spatial encumbrance in reloading and otherwise interfacing with the weapon without exposure to excessive noise or blast hazards. Those skilled in the art of unsteady nozzle behavior and pressure vessel design may optimize the design to minimize size or weight of the resulting blast tube extended nozzles. In particular, for the blast tube to occur in a subsonic region of nozzle flow requires higher pressure containment but a smaller passage than one designed to operate in a supersonic region of flow.

Figure 6B:
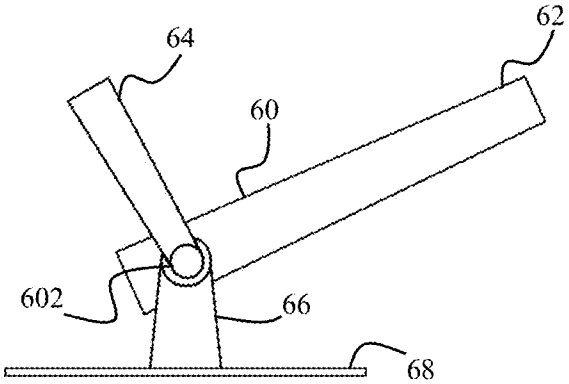
FIG. 6B is a side view of a mortar weapon system at an elevated fire position, with a counter momentum generator, according to one illustrative embodiment.
Figure 6A:
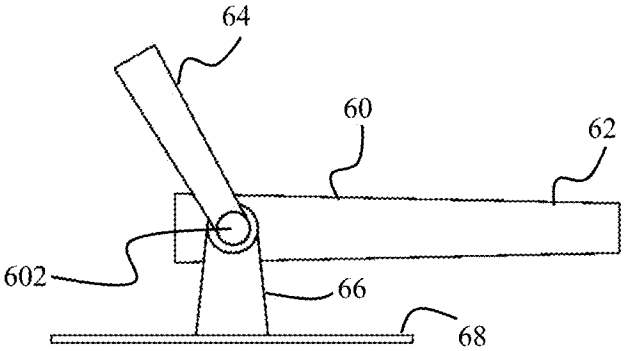
FIG. 6A is a side view of a mortar weapon system at a direct fire position with a counter momentum generator, according to one illustrative embodiment.

FIG. 6A is a side view of a mortar weapon system at a direct fire position with an integrated counter momentum generator, according to one illustrative embodiment. FIG. 6B is a side view of a mortar weapon system at an elevated fire position, with an integrated counter momentum generator, according to one illustrative embodiment.

The mortar weapon system 60 shown in FIGS. 6A and 6B is a barbette mounted mortar weapon system 60. The mortar weapon system 60 comprises a cannon 62, a counter momentum generator 64, a lower pedestal 66 and a baseplate 68. The baseplate 68 is in contact with the ground and serves to couple the combined momentum to the earthen soil upon which it rests. The lower pedestal 66 serves as a pivot yoke allowing elevation of the tipping parts within the trunnions 622. It pivots with the tipping parts in traverse about a lower pintle integrated within the baseplate 68.

For illustrative purposes, the mortar weapon system 60 is shown with trunnions 602 elevated well above the baseplate. In practice, these may be recessed, as is done for typical mortar ball caps, with concomitant loss of minimum elevation. Additionally, neither equilibrators nor bipods are depicted for simplicity.

FIG. 6A shows the mortar weapon system 60 in a direct fire position with the central axis of the cannon 62 oriented at zero degrees with respect to the horizontal. The counter momentum generator 64 is oriented at an angle 202 of $\beta=120°$ degrees with respect to the horizontal. FIG. 6B shows the mortar weapon system 60 at an elevated fire position. The cannon 62 is oriented at an angle of 33 degrees. The counter momentum generator 64 is held at the fixed angle of $\beta=120°$ degrees with respect to the horizontal.

Embodiments such as this one may rigidly fix the counter momentum angle 202 to the upper carriage or baseplate 68 for all elevations of fire. This may aid in the providing a consistent servicing and user interface to the weapon regardless of its elevation of fire. Setting $\beta=180°$ with a suitably long blast tube may significantly reduce impairment of access to the weapon at the expense of causing a more extensive back blast hazard zone.

However, other embodiments may rigidly fix the counter momentum angle 202 to the tipping cradle or cannon 62. Stated another way, the counter momentum angle 202 would be set such that $\beta=\alpha+\varphi$ where $\varphi$ would be fixed and would likely be constrained such that $90°\leq\varphi<180°$. $\varphi=180°$ corresponds to an alignment similar to a recoilless rifle or normal muzzle brake.) If $\varphi=110°$ the launch angle 102 could elevate to typical howitzer levels of 700 with rearward horizontal counter momentum discharge. Such a design would have $\beta=110°$ in direct fire.

Still other embodiments may adjust the counter momentum angle 202 to the actual firing of individual rounds to optimize performance. In addition to adjusting the counter momentum angle 202 to optimize performance, other embodiments may incorporate means to adjust the amount of counter momentum 210 developed to meet performance objectives. Further such adjustment may be coupled to the actual elevation of the cannon through devices such as gears and cams to ensure firing compliance with design intent. As a corollary to this embodiment, muzzle velocity variation may be achieved to augment or usurp propellant zoning intended to control muzzle velocity.

Figure 7:
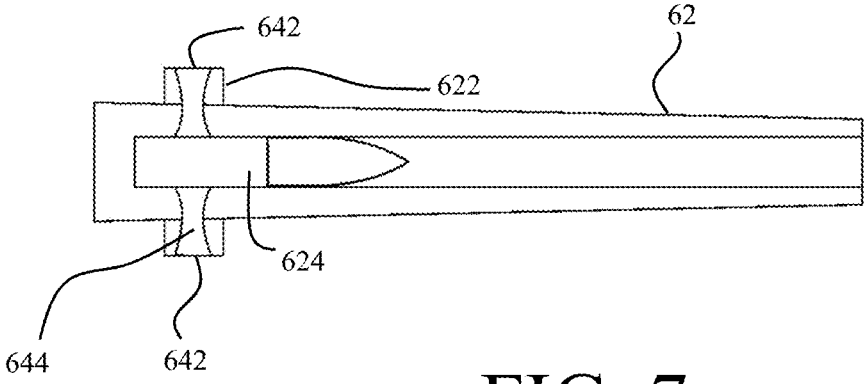
FIG. 7 is top cross sectional view of the cannon of the mortar weapon system of FIGS. 6A and 6B, according to an illustrative embodiment.
Figure 8:
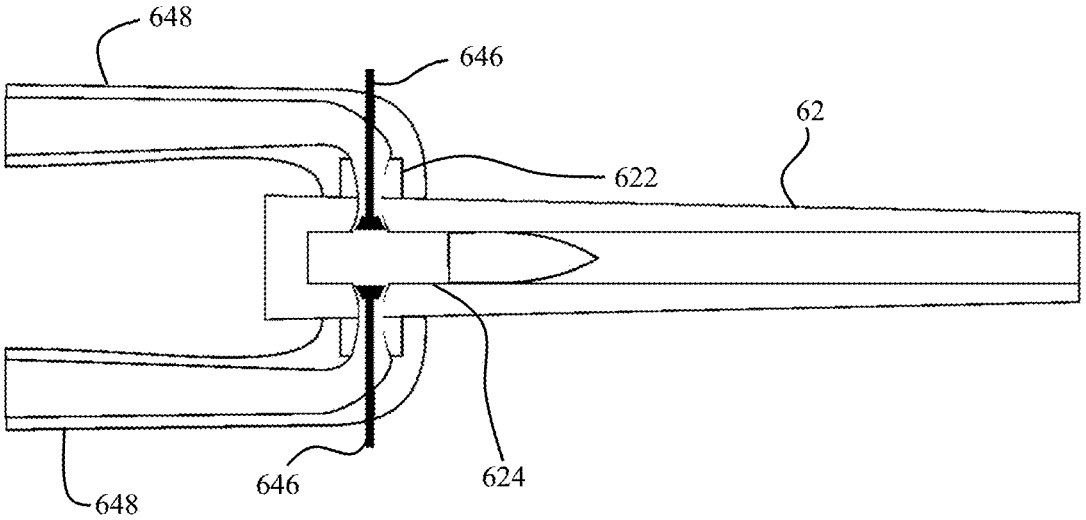
FIG. 8 is a top cross sectional view of the cannon and counter momentum generator of the mortar weapon system of FIGS. 6A and 6B, according to an illustrative embodiment.

FIG. 7 is top cross sectional view of the cannon of the mortar weapon system of FIGS. 6A and 6B, according to an illustrative embodiment. FIG. 8 is a top cross sectional view of the cannon and counter momentum generator of the mortar weapon system of FIGS. 6A and 6B, according to an illustrative embodiment.

The cannon 62 comprises integral trunnion pins 622 extending from an outer surface of the breech of the cannon 62. The trunnions 622 interface with the lower pedestal 66 to allow tipping of the cannon 62 in the elevational plane to increase or decrease the angle of fire of the cannon 62.

The counter momentum generator 64 is integral to the mortar cannon 62 and shares a common pressure source with the gun chamber 624. The counter momentum generator further comprises a first venturi nozzle 642 and a second venturi nozzle 642, each extending through a corresponding one of the integral trunnion pins 622. The first venturi nozzle 642 and second venturi nozzle 642 serve as ports through the gun chamber wall 624 and provide access to the gun chamber and pressures within the chamber caused by projectile launch. The narrow neck 644 of each venturi nozzle 642 may serve to meter and accelerate the flow between the mortar cannon 62 and the outlet of the counter momentum generator during operation. The counter momentum generator 210 further comprises a first nozzle valve 646 and a second nozzle valve 646 to alter the ratio of counter momentum 210 to recoil momentum 110.

The counter momentum generator 210 further comprises a first outlet nozzle 648 and a second outlet nozzle 648. For clarity, the first outlet nozzle 648 and the second outlet nozzle 648 are shown oriented in line with the mortar cannon 62. However, as described above, in this embodiment the first outlet nozzle 648 and the second outlet nozzle 648 are oriented at a constant discharge angle 202 of 120° with respect to the horizontal. Each outlet nozzle 648 receives expelled propellant gas from the venture nozzles 642 and directs the propellant gas away from the cannon 62 and the external environment at the desired direction.

In operation, a projectile is received in the cannon 62. The projectile is propelled through the bore and out of the muzzle of the cannon 62 by high pressure gases caused by the ignition of a propellant within the breech of the cannon 62. A recoil momentum 110 is generated by the ejection of the projectile in the direction of the elevation angle 102 and toward the baseplate. Concurrently, a portion of the high pressure gas is directed through the first venturi nozzle 642 and the second venturi nozzle 642 as determined by the position of the first nozzle valve 644 and second nozzle valve 644. The high pressure gas exits each of the venturi nozzles 642 and is directed to the first outlet nozzle 648 and second outlet nozzle 648. The high pressure gas is expelled to the external environment from the first outlet nozzle 648 and the second outlet nozzle 648 at a discharge angle 202 of β=120°.

The discharge of the gas from the outlet nozzles 648 produces the counter momentum 210 at the angle of the discharge angle 202 and toward the baseplate 68. The vertical component of the counter momentum 210 combines in an additive relationship with the vertical component of the recoil momentum 110. The combined momentum vertical momentum serves to the increase the compressive force directed onto the ground and thereby increase the stability of the baseplate on the earthen soil. The horizontal component of the counter momentum 210 combines with the horizontal component of the recoil momentum 110 in a subtractive relationship thereby reducing the shear forces between the baseplate 68 and the ground. As the recoil momentum 110 vector and the counter momentum 210 vector intersect the trunnion pin 602, no torque is generated about the trunnion pin 602. However, remaining horizontal recoil passing through the trunnion pin 602 could lead to instability.

Figure 9:
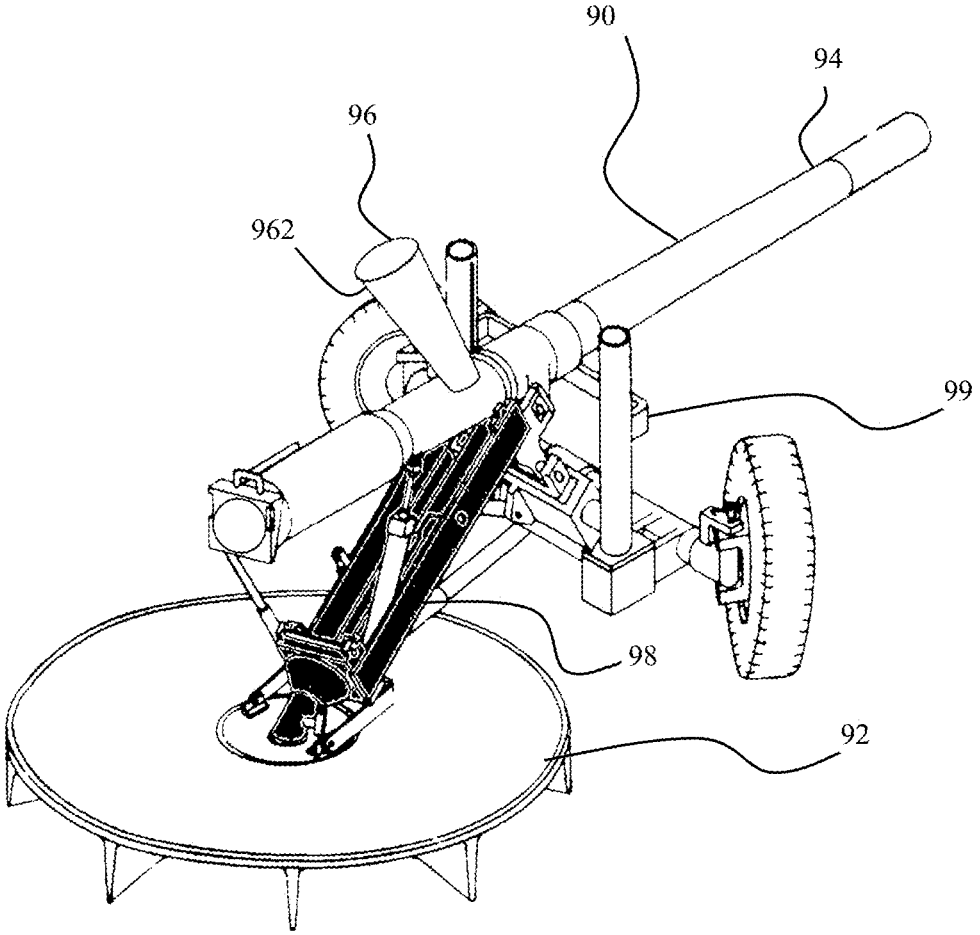
FIG. 9 is an isometric view of a mortar weapon system with a counter momentum generator, according to an illustrative embodiment.

FIG. 9 is an isometric view of a mortar weapon system with a counter momentum generator, according to an illustrative embodiment. The mortar weapon system 90 shown is a baseplate mounted mortar weapon system 90 capable of direct fire. The mortar weapon system comprises a baseplate 92, a cannon 94, a counter momentum generator 96, a base cap extension 98 and a bipod 99.

The counter momentum generator nozzle 962 is at a fixed angle 202 with respect to the cannon 94. The counter momentum generator 96 is ducted from the chamber of the cannon 94 to generate the counter momentum 210. The embodiment shown overcomes the impediment of the bipod 99 to allow zero elevation fire. This approach directs the momentum to place the base cap extension 98 into compression with minimum off axis loading. As the nozzle 962 is fixed at an angle of 120° with respect to the cannon 94, the nozzle 962 would be defeated for fires above 45°. As it is not the intent to directly counteract all recoil, the counter momentum generator need not be opposite in direction or magnitude to the bore as in other direct fire weapon systems, including recoilless rifles.

Figure 10:
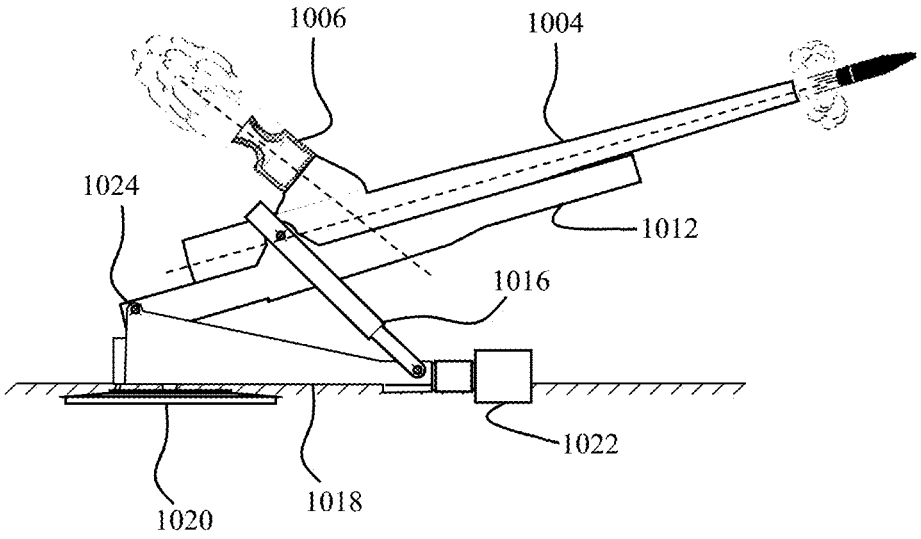
FIG. 10 is a side cross sectional view of a recoiling artillery weapon system with a counter momentum generator, according to an illustrative embodiment.

FIG. 10 is a side cross sectional view of a recoiling artillery weapon system with a counter momentum generator, according to an illustrative embodiment. The artillery weapon system 1000 employs a counter momentum generator 1006 to change the direction of recoil thereby making the system more stable and decreasing the reliance upon weapon weight applied through the forward floats to stabilize the system. As described above, the counter momentum generator 1006 may be placed at different locations along the length of the cannon and FIG. 10 shows an embodiment with the counter momentum generator 1006 located forward of the breech of the cannon 1004.

The artillery weapon system 1000 comprises a carriage 1010. The carriage 1010 is adapted from that of the US Army's M204 105 mm howitzer. The carriage 1010 further comprises a cradle 1012 which supports the cannon 1004. The cradle 1012 includes an internal recoil arresting system for mitigating the magnitude of the recoil force required to transfer the recoil momentum 110 to the ground. A lower carriage 1014 supports the rear of the cradle 1012 and provides a pivot yoke for the cradle 1012 to rotate in the elevational plane. A telescoping elevation and equilibrator strut 1016 connects the cradle 1012 to the lower carriage 1018. The telescoping elevation and equilibrator strut 1016 raises and lowers the elevation of the cradle 1012 and thereby the elevation of the cannon 1004. The lower carriage 1018 rests on a turntable 1020 which in turn rests on the ground.

Similar to the M204, the carriage 1010 includes forward outrigger floats 1022 in the form of rollers. The arrangement is analogous to the 160 mm Tampella heavy mortar developed by Oy Tampella Ab of the Republic of Finland. The 160 mm Tampella heavy mortar employs two transportation wheels to stabilize the cannon forward of its baseplate. In the 160 mm Tampella heavy mortar, M204 and the embodiment shown in FIG. 10, the two wheels serve a function much like that of a mortar bipod mount. Unlike the 160 mm Tampella heavy mortar, the elevating trunnions of the M204 and present embodiment are located above the ground level, whereas mortar baseplates typically employ a ball joint within the baseplate that couples the plate to the cannon.

The launch recoil 110 is directed parallel to the recoil path of the cannon within the cradle 1012 that is elevated about the trunnions. As depicted, the recoil momentum 110 would intersect the horizontal ground some distance to the left of (behind) the turntable 1020. Absent any counter momentum 210, this will create a torque tending to raise the roller floats and tip the lower carriage 1018 counter clockwise about the left end of the turntable if the weight of the system is insufficient to hold it down.

The component of the counter momentum 210 that is orthogonal to the launch recoil 110 will become manifest as orthogonal translation and rotation of the cannon 1004 and cradle 1012 that develop compressive loads in the elevation strut 1016, roller float 1022, and ground. In effect, a suitably engineered strut 1016 may serve as a kind of off axis recoil arresting system. As before, the recoil momentum 110 and counter momentum 210 may be vectorally added to achieve a net momentum 410. The counter momentum 210 will not only emulate a higher elevation of fire, it will shift the horizontal location where the net momentum 410 intersects the ground. Shifting the intersection point to occur within the span of the turntable 1020 and outrigger float 1022 will reduce or eliminate the tendency of the lower carriage 1018 to tip and thereby provide improved firing stability. However, it should be noted that shifting the intersection point to occur to the right of the float 1022 would tend to tip the lower carriage 1018 in the opposite direction. For example, this could occur if significant counter momentum 210 is developed too close to the muzzle of the cannon 1004.

Forces developed at the trunnion bearing 1024 and elevation struts 1016 are of concern as recoil of the cannon within the cradle 1012 does not aid in attenuating the levels from those of the counter momentum generator 1006. If the counter momentum generator 1006 functions over a duration commensurate with the launch, the forces may be rather large. The concept of the center of percussion of the tipping parts may be applied to consider desirable locations for the counter momentum generator 1006. Accordingly, placement of the effective instantaneous pivot point of the tipping parts during their highest loading between the trunnion bearing and upper strut pivot bearing would be a design methodology to manage bearing force levels. This location may be shifted by altering the counter momentum generator location, orientation, and magnitude.

In an embodiment, these counter momentum generator forces arc reduced by allowing the generator mass to move and have its motion arrested in analogy with traditional cannon recoil. The motion may be constrained to the recoiling cannon or coupled separately to an independent cradle.

While the invention has been described with reference to certain embodiments, numerous changes, alterations and modifications to the described embodiments are possible without departing from the spirit and scope of the invention as defined in the appended claims, and equivalents thereof.

What is claimed is:

1. A system capable of firing a projectile, the system comprising:

a cannon for launching the projectile and the cannon further comprises integral trunnion pins extending from an outer surface of the cannon;

a counter momentum generator coupled to the cannon which produces a counter momentum for countering a recoil momentum of the weapon system, the counter momentum being substantially concurrent with the recoil momentum and having a vertical component which combines with a vertical component of the recoil momentum to increase the compressive force between a baseplate and an external surface and a horizontal component which negates a portion of a horizontal component of the recoil momentum; and the counter momentum generator further comprising a venturi nozzle extending from an interior of the cannon through the integral trunnion pins and an outlet nozzle having an input in communication with the venturi nozzle and an output to the external environment.

2. The weapon system of claim 1 wherein the counter momentum and the recoil momentum are not produced by a common initiation source.

3. The weapon system of claim 2 further comprising a conduit from the counter momentum generator to the cannon wherein a common initiation source can initiate both a propelling source of the projectile and a propelling source of the counter momentum generator.

4. The weapon system of claim 2 wherein the counter momentum generator produces the counter momentum for a duration longer than a duration of the recoil momentum.

5. The weapon system of claim 2 wherein the counter momentum generator produces the counter momentum prior to the recoil momentum.

6. The weapon system of claim 2 wherein the counter momentum generator produces the counter momentum subsequent to the recoil momentum.

7. The weapon system of claim 1 wherein the counter momentum and the recoil momentum are produced by the same initiation source.

8. The weapon system of claim 7 wherein the counter momentum generator shares a common pressure source with a chamber of the cannon.

9. The weapon system of claim 7 wherein the counter momentum generator shares a common pressure source with a location along a bore of the cannon that is not active until the projectile passes over the location.

10. The weapon system of claim 7 wherein the counter momentum generator shares a common pressure source with a location along a bore of the cannon and is configured such that the counter momentum generator produces the counter momentum at a desired time.

11. The weapon system of claim 7 wherein the counter momentum generator shares a common pressure source with a muzzle of the cannon.

12. The weapon system of claim 7 wherein the counter momentum generator further comprises a booster propellant for increasing the magnitude of the counter momentum.

13. The weapon system of claim 7 wherein the counter momentum generator further comprises a countermass for being ejected from the counter momentum generator.

14. The weapon system of claim 7 further comprising a flow restrictor between the counter momentum generator and the cannon.

15. The weapon system of claim 7 wherein the counter momentum generator further comprises a reservoir volume between a downstream choke and a cannon egress port.

16. The weapon system of claim 7 wherein the counter momentum generator port includes a control valve.

17. The weapon system of claim 1 wherein the counter momentum generator is located along the cannon such that a component of the counter momentum that lays perpendicular to a cannon orientation will by way of reaction produce a rotation of the cannon about a trunnion of the cannon without additional horizontal or vertical forces at the trunnion.

18. A weapon system capable of firing a projectile at a low elevation angle, the weapon system comprising:

a cannon which receives the projectile and which further comprises an integral trunnion pin extending from an outer surface of the cannon;

a barbette pedestal for mounting the cannon to a baseplate and serving as a pivot yoke for the integral trunnion pins thereby allowing elevation of cannon;

the baseplate having a bottom surface in contact with an external surface and a top surface on which the barbette pedestal is pivotably mounted; and a counter momentum generator for producing a counter momentum to counter a recoil momentum of the weapon system, the counter momentum having a vertical component which combines with a vertical component of the recoil momentum to increase the compressive force between the baseplate and the external surface and a horizontal component which negates a portion of a horizontal component of the recoil momentum, the counter recoil generator further comprising a venturi nozzle extending from an interior of the cannon through the integral trunnion pins and an outlet nozzle having an input in communication with the venturi nozzle and an output to the external environment.

19. The weapon system of claim 18 wherein the outlet nozzle is at a fixed discharge angle with respect to the cannon.

20. The weapon system of claim 18 wherein the outlet nozzle is at a variable discharge angle with respect to the cannon.

* * * * *